US006190002B1

(12) United States Patent
Spivey

(10) Patent No.: US 6,190,002 B1
(45) Date of Patent: Feb. 20, 2001

(54) INK JET PEN

(75) Inventor: Paul Timothy Spivey, Nicholasville, KY (US)

(73) Assignee: Lexmark International, Inc., Lexington, KY (US)

( * ) Notice: Under 35 U.S.C. 154(b), the term of this patent shall be extended for 0 days.

(21) Appl. No.: 09/428,080

(22) Filed: Oct. 27, 1999

(51) Int. Cl.[7] ..... B41J 2/14
(52) U.S. Cl. ..... 347/50
(58) Field of Search ..... 347/20, 22, 40, 347/50, 49, 87, 33

(56) References Cited

U.S. PATENT DOCUMENTS

| | | | | |
|---|---|---|---|---|
| 4,578,686 | | 3/1986 | Vollert . | |
| 5,148,194 | * | 9/1992 | Asai et al. | 347/49 |
| 5,333,007 | | 7/1994 | Kneezel et al. . | |
| 5,388,326 | | 2/1995 | Beeson et al. . | |
| 5,530,463 | | 6/1996 | Nystrom et al. . | |
| 5,537,133 | | 7/1996 | Marler et al. . | |
| 5,576,750 | | 11/1996 | Brandon et al. . | |
| 5,644,347 | | 7/1997 | Schwiebert . | |
| 5,670,997 | * | 9/1997 | Sugimoto et al. | 347/30 |
| 5,706,038 | | 1/1998 | Jackson et al. . | |
| 5,736,998 | | 4/1998 | Caren et al. . | |
| 5,751,323 | | 5/1998 | Swanson . | |
| 5,774,140 | | 6/1998 | English . | |
| 5,781,209 | | 7/1998 | Yoshimura . | |
| 5,786,830 | | 7/1998 | Su et al. . | |
| 5,815,177 | | 9/1998 | Sasaki . | |
| 5,831,660 | * | 11/1998 | Kubo et al. | 347/238 |
| 5,870,116 | | 2/1999 | Kyoshima . | |
| 5,896,143 | * | 4/1999 | Matsui et al. | 347/24 |

FOREIGN PATENT DOCUMENTS

| | | |
|---|---|---|
| 0644051 A1 | 8/1994 | (EP) . |
| 03227646 | 10/1991 | (JP) . |
| 405201014 | 8/1993 | (JP) . |

* cited by examiner

*Primary Examiner*—N. Le
*Assistant Examiner*—Michael Nghiem
(74) *Attorney, Agent, or Firm*—Michael T. Sanderson; Luedeka, Neely & Graham

(57) ABSTRACT

The invention relates to an improved ink jet pen for an ink jet printer. The pen includes a pen body having raised end walls, a recessed substantially planar portion between the end walls containing two or more printheads and flexible circuits therefor, the flexible circuits being attached to the pen body in the recessed portion between the raised end walls. A polymeric material is disposed between adjacent flexible circuits in the recessed portion having a height sufficient to protect a wiper from damage from exposed edges of the flexible circuits between adjacent printheads during a printhead cleaning operation. The improved pen lends itself to simplified manufacturing processes yet provides enhanced mechanical protection of the wiper and critical electrical structures and enhanced corrosion resistance from ink.

18 Claims, 3 Drawing Sheets

INK JET PEN

FIELD OF THE INVENTION

The invention relates to ink jet printers and in particular to an improved ink jet pen having a printhead surface adaptable for cleaning and to methods for making ink jet pens.

BACKGROUND OF THE INVENTION

During the lifespan of an ink jet pen containing one or more printheads, ink mist, dried ink and debris from the print media tend to accumulate on the nozzle plates of the printheads adjacent orifice holes therein. If not removed, the debris may accumulate to the point it blocks or partially blocks ejection of ink from the nozzle holes. Periodically, therefor, it is necessary to remove the debris from adjacent the nozzle holes so that the performance of the pen will not be impaired. Cleaning of the nozzle plates may be conducted using solvents or preferably by passing a flexible wiper across the nozzle plate to loosen and remove ink mist, dried ink and debris such as paper fibers therefrom. A wide variety of wipers and wiper blade designs are used for cleaning ink jet printhead nozzle plates.

In order to effectively clean a nozzle plate of a printhead with a wiper device, the pen must have a structure or configuration which lends itself to effective wiping across the nozzle plate or plates of the printheads. A single color ink jet pen contains a single printhead and a flexible circuit connected to a silicon substrate containing heater resistors and control devices for selectively ejecting ink from one or more nozzle holes of the printhead. Typically, the flexible circuit surrounds the nozzle plate or is integrally formed with the nozzle plate and is attached to a printhead carrier structure or pen body in a recessed portion therein. The raised sides of the pen body are often sufficient to protect the wiper from the relatively sharp edges of the flexible circuit as the wiper traverses the nozzle plate during a cleaning operation.

As contrasted with a single color ink jet pen, a multi-color pen contains multiple nozzle plates and associated flexible circuits for the printheads thereof. Typically, only the raised portions of the pen body adjacent the outermost edges of the flexible circuits protect the wiper as the blade of the wiper traverses the nozzle plates. It is difficult to adequately protect the wiper from interior edge portions of the flexible circuits remote from the raised portions of the pen body between adjacent nozzle plates because of printhead spacing tolerances. Thus these interior portions of the flexible circuits are often exposed. During a cleaning operation, as the flexible wiper blade traverses across the printhead surface of the pen body, the exposed edges of the flexible circuits can damage and/or cause excessive wear on the wiper.

SUMMARY OF THE INVENTION

With regard to the foregoing, the invention provides an improved ink jet pen for an ink jet printer. The ink jet pen includes a pen body having raised end walls, a recessed substantially planar portion between the end walls containing two or more printheads and flexible circuits therefor, each flexible circuit having at least one exposed edge. The flexible circuits are attached to the pen body in the recessed portion between the raised end walls and a polymeric thermoplastic material is disposed between adjacent flexible circuits in the recessed portion. The polymeric material has a height sufficient to protect a wiper from damage from the exposed edges of the flexible circuits between adjacent printheads during a printhead cleaning operation.

In another aspect the invention provides a method for protecting a wiper of a printhead cleaning station of an ink jet printer from damage from edges of a flexible circuit attached to an ink jet pen body during a printhead cleaning operation. The method includes providing a pen body having raised end walls and a recessed substantially planar portion between the end walls. A thermoplastic adhesive film is applied to the planar portion of the pen body and one or more printheads and one or more flexible circuits therefor are attached to the adhesive film in the recessed portion of the pen body. The one or more flexible circuits have first and second edges. Once attached to the adhesive film, the flexible circuits and film are heated under pressure to a temperature sufficient to cause the adhesive film to flow and encapsulate at least one of the first or second edges of the flexible circuits. The flowed adhesive film is then cooled in the encapsulated state to harden the flowed film and provide the first and second edges in a protected state sufficient to protect the wiper from damage from exposed edges of the flexible circuit during a printhead cleaning operation.

In yet another aspect the invention provides an ink jet printer having a printer housing and a printhead cleaning station and including an ink jet pen and ink cartridge containing ink attached to the pen. The pen contains a pen body having raised end walls, a recessed substantially planar portion between the end walls and two or more printheads and flexible circuits therefor, each flexible circuit having at least one exposed edge. The flexible circuits are attached to the pen body in the recessed portion between the raised end walls. A thermoplastic polymeric material is disposed between adjacent flexible circuits in the recessed portion and has a height sufficient to protect a wiper from damage caused by exposed edges of the flexible circuits during a printhead cleaning operation.

An advantage of the devices and methods of the invention is that the edges of flexible circuits attached to a multi-color ink jet pen body are protected so as to reduce damage and/or excessive wear to the flexible wiper blade and/or flexible circuit during printhead cleaning operations. Another advantage is that the polymeric material effectively encapsulates the edges of the flexible circuits thereby improving the ink resistance of the flexible circuits. Still another advantage is that the devices and methods enable cost effective manufacturing techniques and eliminate the need for applying individual encapsulant materials to the edges of the flexible circuit.

For the purposes of this invention the terminology "exposed edges" means those edges of the flexible circuits which if left unencapsulated provide relative sharp edges which could contact and cause damage or excessive wear to a wiper blade during a printhead cleaning. For the most part, exposed edges include the edges of the flexible circuits between adjacent printheads. The edges of the flexible circuits adjacent the sides of the pen body are somewhat protected by raised end walls on the pen body as described in more detail below and thus may be exposed, partially exposed or unexposed depending on the height of the end walls and the proximity of the edges to end walls.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE INVENTION

Figure 1:
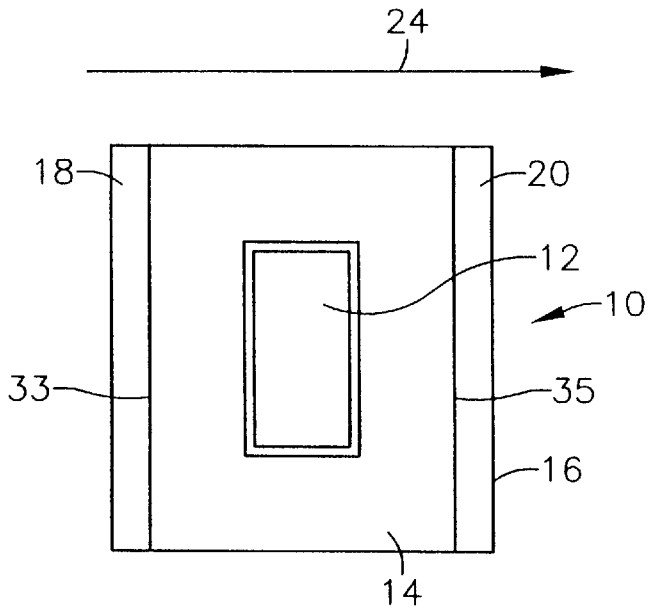
FIG. 1 is a top plan view of an ink jet pen and pen body containing a single printhead.
Figure 2:
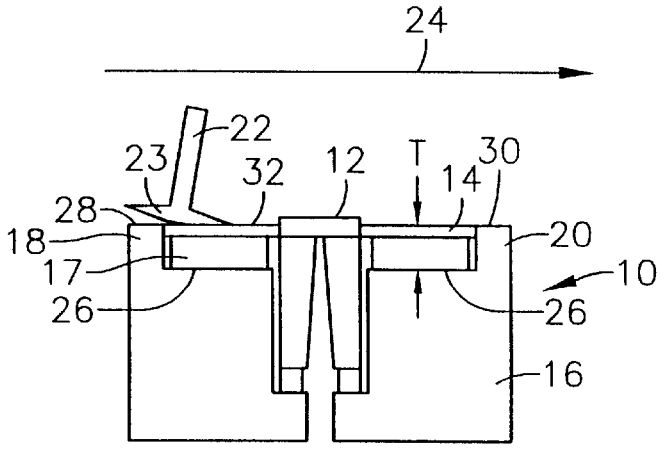
FIG. 2 is a cross-sectional view of an ink jet pen containing a single printhead and wiper therefor.

For the purpose of background and with reference to FIGS. 1 and 2 there is shown the operating surface of an ink jet pen 10 containing a printhead 12 and a flexible circuit 14 attached to the pen body 16 by means of adhesive 17 between raised end walls 18 and 20. During a printhead cleaning step, a wiper 22 traverses the printhead 12 and flexible circuit 14 in a direction crosswise to the longest dimension of the printhead 12 as generally indicated by arrow 24. As the blade 23 of the wiper 22 traverses the printhead 12, debris, dried ink and/or ink mist deposits are swept from the face of the printhead nozzle plate thereby improving printer performance and reducing the build up of deposits on the printhead which could affect the ejection of ink from the printhead.

Figure 2A:
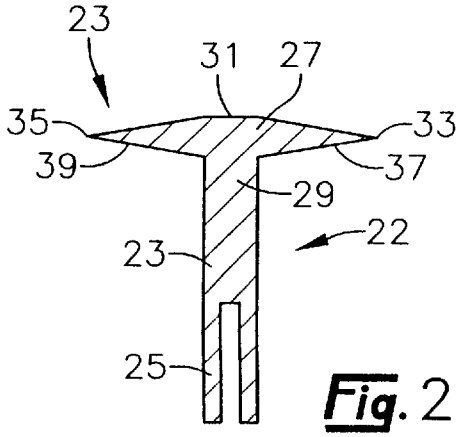
FIG. 2A is a cross-sectional view of a wiper for cleaning pens according to the invention.

The wiper 22 is preferably made from a polyester-based polyurethane such as a product available from Bayer Corporation-Polymers Division. of Pittsburgh, Pa. under the trade name TEXIN. Suitable polyester-based polyurethane materials preferably have a durometer of approximately 85 Shore A hardness. The wiper 22 may have a generally rectangular shape. A particularly preferred wiper 22 is shown in cross-section in FIG. 2A and has a flexible body including a mounting portion 25, a wiper blade 23 containing a wiping portion 27 and a beam portion 29 connecting the blade 23 to the mounting portion 25. The wiping portion 27 includes an upper substantially planar surface 31 having first and second opposing wiping edges 33 and 35 and first and second opposing side surfaces 37 and 39 opposite the upper surface 31 which diverge at an acute angle from the first and second wiping edges 33 and 35 respectively and intersect the beam portion 29 on opposing sides thereof. Wipers 22 suitable for use with the ink jet pens of the invention are described more fully in U.S. Pat. No. 5,612,722 to Francis et al. issued Mar. 18, 1997, the disclosure of which is incorporated by reference as if fully set forth herein.

Other features of a mono or single color pen are shown in cross-sectional view in FIG. 2. As can be seen, the pen body 16 has a recessed substantially planar portion 26 between raised end walls 18 and 20 to which the flexible circuit 14 and printhead 12 are attached, preferably by an adhesive 17. The raised end walls 18 and 20 have a height which is substantially equal to or greater than the thickness T of the flexible circuit 14 and adhesive 17 such that the upper surfaces 28 and 30 of end walls 18 and 20, respectively, are no lower than the planar surface 32 defined by exposed surface of the printhead 12 and flexible circuit 14. Accordingly, as the wiper 22 traverses the printhead and flexible circuit 14 from end wall 18 to end wall 20 in the direction of arrow 24 and from end wall 20 to end wall 18 in a direction opposite to arrow 24, the wiper 22 does not engage the edges 33 and 35 of the flexible circuit 14. Hence, in the single printhead embodiment, there are no exposed edges of the flexible circuit 14 which can cause damage to the wiper 22.

Figure 3:
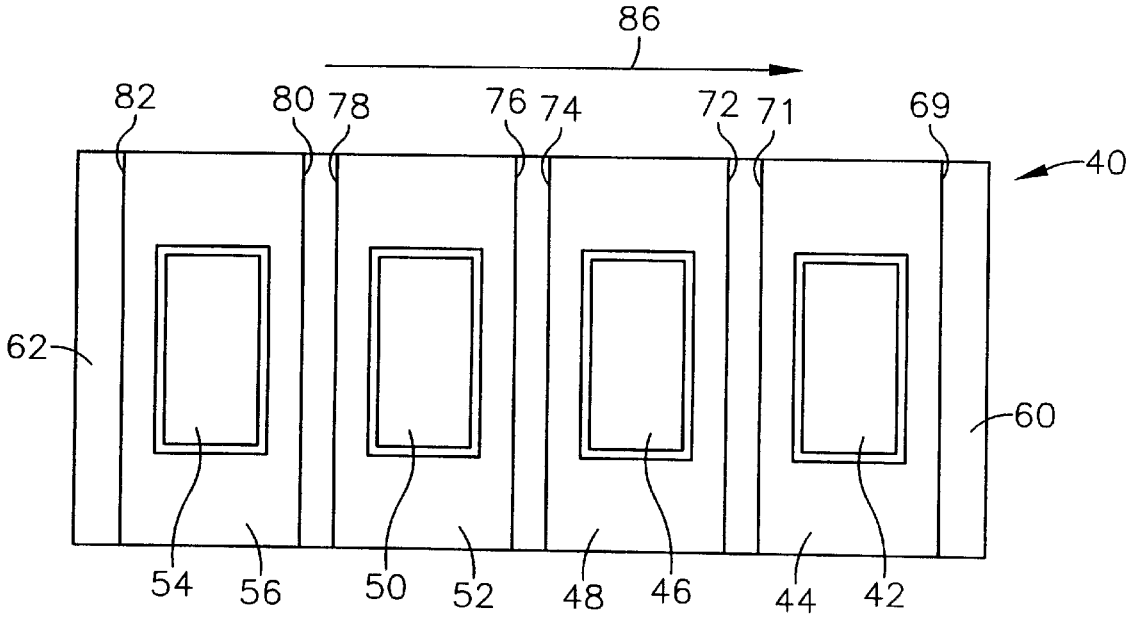
FIG. 3 is a plan view of an ink jet pen and pen body containing multiple ink jet printheads according to the invention.

A plan view of a multi-color ink jet pen 40 is illustrated in FIG. 3. A typical multi-color pen 40 contains at least three colors such as cyan, magenta and yellow and preferably contains a black printhead 42 and flexible circuit 44 therefor, a cyan printhead 46 and flexible circuit 48 therefor, a magenta printhead 50 and flexible circuit 52 therefor and a yellow printhead 54 and flexible circuit 56 therefor. The printheads 42, 46, 50 and 54 which include a semiconductor chip such as chip 55 and flexible circuits 44, 48, 52 and 56 are attached to a pen body 58 (FIG. 4) between end walls 60 and 62 in chip pockets 64 of the pen body 58. An adhesive 66 is preferably used to attach the printheads 42, 46, 50 and 54 to the chip pockets 64 of the pen body 58. Adhesive 68 is used to attach flexible circuits 44, 48, 52, and 56 to the recessed surfaces 70 of the pen body between the individual printheads 42, 46, 50 and 54 and between printhead 42 and end wall 60 and between printhead 54 and end wall 62.

Figure 4:
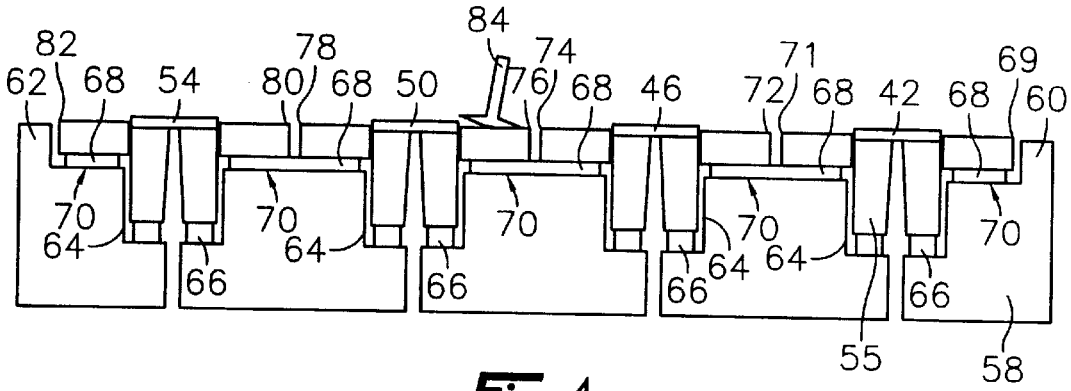
FIG. 4 is a cross-sectional view of an ink jet pen body containing multiple ink jet printheads and flexible circuits therefor.

One or more edges 69, 71, 72, 74, 76, 78, 80 or 82 of flexible circuits 44, 48, 52 and 56 may be exposed so that upon traversal of a wiper 84 across the surface of the printheads in the direction of arrow 86, or in a direction opposite arrow 86, the exposed edges 69, 71, 72, 74, 76, 78, 80 or 82 of the flexible circuits may damage or otherwise excessively wear the wiper 84 or the wiper 84 may urge the flexible circuits 44, 48, 52 and 56 away from the recessed surface 70 of the pen body. Likewise, the flexible circuits 44, 48, 52 and 56 may be damaged or worn by the wiper 84 as the wiper 84 traverses across the printheads in the direction of arrow 86. As shown in FIG. 4, end walls 60 and 62 provide minimal protection to edges 69 and 82 of flexible circuits 44 and 56 respectively. However, even if end walls 60 and 62 protect edges 69 and 82, exposed edges 71, 72, 74, 76, 78 and 80 are still subject to damaging the wiper 84. Likewise, ink which deposits or accumulates between the printheads may corrode or otherwise attack any exposed metal traces on the flexible circuits thereby causing premature pen failure.

Ideally, the body 58 of such a multicolor pen should include recessed portions 70 between raised walls for each of the printheads 42, 46, 50 and 54 and their corresponding flexible circuits 44, 48, 52 and 56. However, as the spacing between adjacent printheads is decreased, it becomes increasingly more difficult to provide raised walls between adjacent flexible circuits without affecting the alignment of the printheads and flexible circuits on the pen body 58 and increasing the overall width of the pen. The present invention enables a reduction in the spacing between the printheads which provides a relatively narrower overall width for the pen and ink cartridge attached thereto. A narrower width enables use of a narrower printer box resulting in significant cost savings due to reduced material costs.

Figure 5:
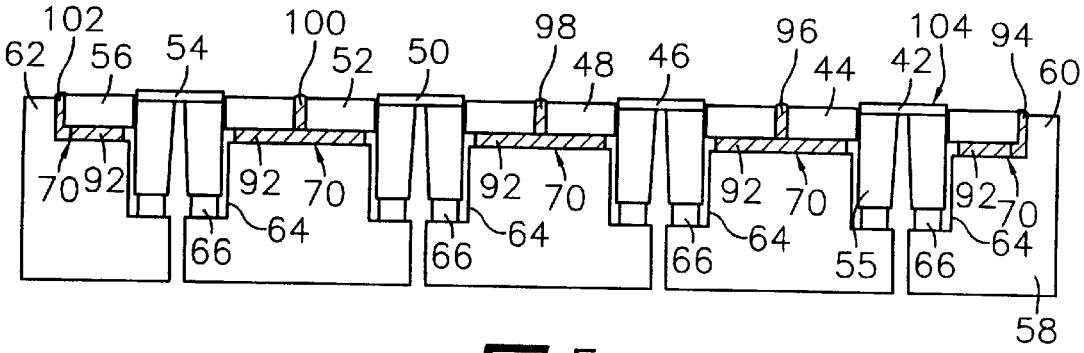
FIG. 5 is a cross-sectional view of a multi-color ink jet pen according to the invention.

An improved ink jet pen 90 according to the invention is illustrated in cross-sectional view in FIG. 5. A pen body 58 contains printheads 42, 46, 50 and 54 attached to semiconductor chips such as chip 55 and flexible circuits 44, 48, 52 and 56 therefor. Each of the printheads 42, 46, 50 and 54 and corresponding chips 55 is attached to the pen body 58 in a chip pocket 64 using an epoxy adhesive 66 and each of the flexible circuits 44, 48, 52 and 56 is attached to a recessed surface 70 of the pen body 58 by means of a thermoplastic adhesive 92. The adhesive, as described in more detail below, is caused to flow between adjacent flexible circuits, between flexible circuit 44 and raised end wall 60 and between flexible circuit 56 and raised end wall 62 forming raised portions 94, 96, 98, 100 and 102 which have a height at least equal to or above a plane defined by the exposed surface 104 of the printheads and flexible circuits which is opposite adhesive 92.

As shown in FIG. 5 in comparison to FIG. 4, the raised portions 94, 96, 98, 100 and 102 of the adhesive 92 solidify when cooled and effectively encapsulate the edges of flexible circuits 44, 48, 52 and 56, therefore protecting wiper from damage caused by the edges of the flexible circuits during a wiping or cleaning operation. Additional benefits of the encapsulation of the edges of the flexible circuits are that any exposed metal traces on the flexible circuits are protected from corrosion from ink or other materials and there is less tendency for the wiper to urge the flexible circuits away from the recessed surfaces 70 of the pen body 58.

In a preferred fabrication method for an ink jet pen 90 according to the invention, first a nozzle plate is bonded to a semiconductor chip such as chip 55 using well known bonding techniques. The nozzle plate/chip assembly is then bonded to a flexible circuit such as flexible circuit 44. In a separate step, a thermoplastic adhesive 92 is applied to the recessed portions 70 of the pen body 58. An epoxy adhesive 66 is dispensed in the chip pockets 64 of the printhead body 58, the nozzle plate/chip/circuit assemblies are aligned and attached to the printhead body 58 and the epoxy adhesive 66 is cured in an oven. The plate/chip/circuit assemblies may be held in place until the epoxy is cured by use of a UV curable adhesive which is also dispensed in the chip pockets 66. Finally, the flexible circuits 44, 48, 52 and 56 are heat staked into the thermoplastic adhesive 92 and heat is applied to the exposed surface of the flexible circuits 44, 48, 52 and 56 which is sufficient to cause the adhesive 92 to flow and encapsulate the edges of the flexible circuits.

Figure 6:
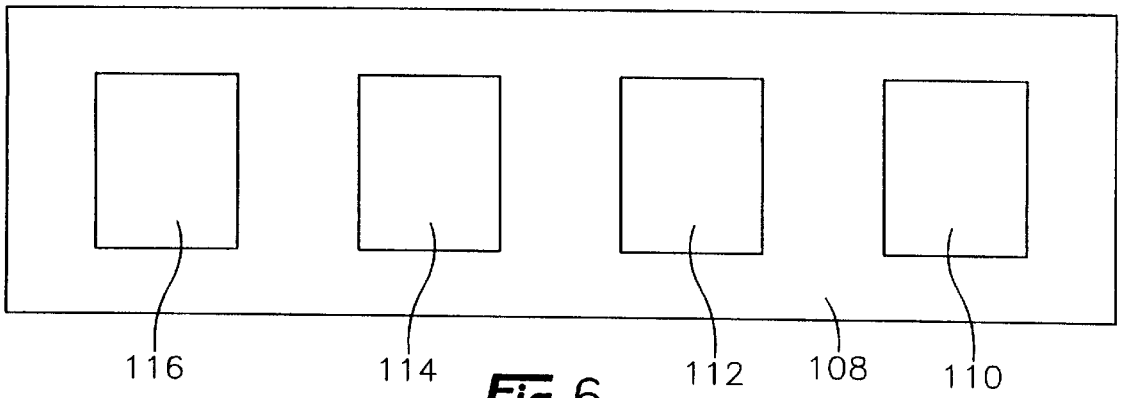
FIG. 6 is a plan view of an adhesive film according to the invention.

In accordance with the invention, a particularly preferred thermoplastic adhesive 92 is in the form of an adhesive film 108 which may be applied to the recessed portions 70 of the pen body 58 before attaching the plate/chip/circuit assemblies to the body 58. A particularly preferred adhesive film 108 is illustrated in plan view in FIG. 6. The adhesive film is preferably a flexible polyolefin, non-curing thermoplastic bonding film 108 such as available from Minnesota Mining and Manufacturing Company of Saint Paul, Minn. under the trade name 3M THERMO-BOND 845. Such film 108 has a thickness ranging from about 2.0 to about 5.0 mils and includes a polyolefin based-resin having a softening point in the range of from about 80° to about 150° C. Under heat and pressure of from about 5 to about 60 psig, the film 108 is caused to soften and flow thereby bonding the flexible circuits to the pen body 58. As the film soften and flows, it also extrudes between the flexible circuits and then solidifies or hardens as it cools to form the raised portions 94, 96, 98, 100 and 102 as shown in FIG. 5. Such a film is particularly useful for pen bodies 58 which are made of polymeric materials such as NORYL polymer available from General Electric company of New York, N.Y. having a softening point of from about 130° to about 150° C. In the case of pen bodies made of a higher temperature polymer or metal, a higher softening temperature thermoplastic film such as a polyurethane ether, non-curing thermoplastic bond film available from Deerfield Urethane, Inc. of South Deerfield, Mass. under the trade name DEERFIELD PT 9300 having a softening point in the range of from about 150° to about 250° C. under a pressure of about 10 to about 100 psig may be used as film 108.

It is preferred that the film 108 not be tacky at room temperature because the alignment of the chips 55 to the pen body 58 (FIG. 5) is critical to the proper functioning of the ink jet pen. Accordingly, as described above, the nozzle plate/chip/flexible circuit assembly is aligned and placed on the printhead body 58 in the chip pockets 64 and the chip adhesive 66 is cured prior to bonding the flexible circuits 44, 48, 52 and 58 to the adhesive film 108. If the film 108 has a tacky surface, the flexible circuits 44, 48, 52 and 58 would stick to the film and likely cause the plate/chip/flexible circuit assembly to shift out of alignment.

In order to enable proper placement of the plate/chip/flexible circuit assembly in the chip pockets 64 of the pen body, it is preferred that the film 108 contain apertures 110, 112, 114 and 116 corresponding to the printheads 42, 46, 50 and 54. If the film 108 were solid and contained no openings or apertures 110, 1 12, 114 and 116, the film would have to be cut to insert the plate/chip assemblies therethrough as the plate/chip assemblies are attached in the chip pockets.

Figure 7:
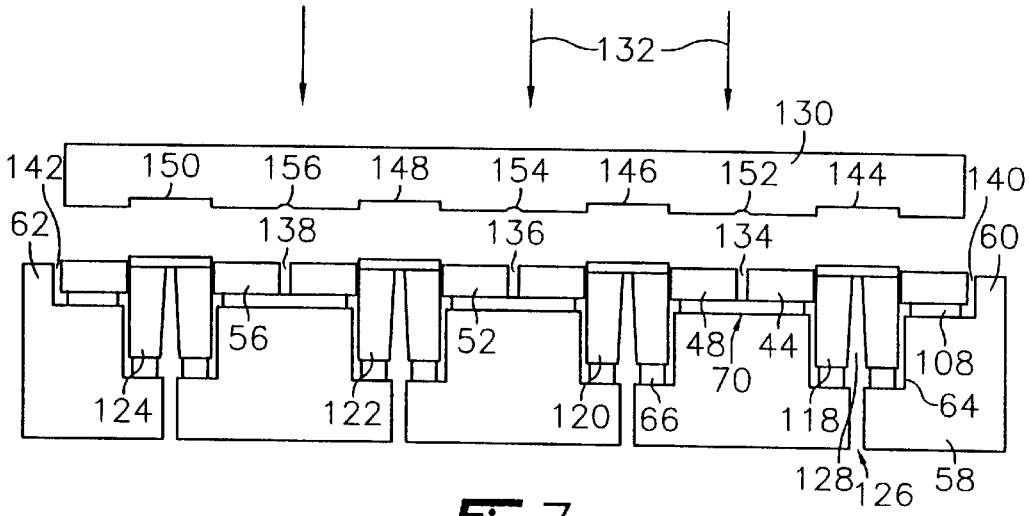
FIGS. 7 and 8 are sequential cross-sectional views of a method for protecting a wiper and/or flexible circuits on an ink jet pen according to the invention.
Figure 8:
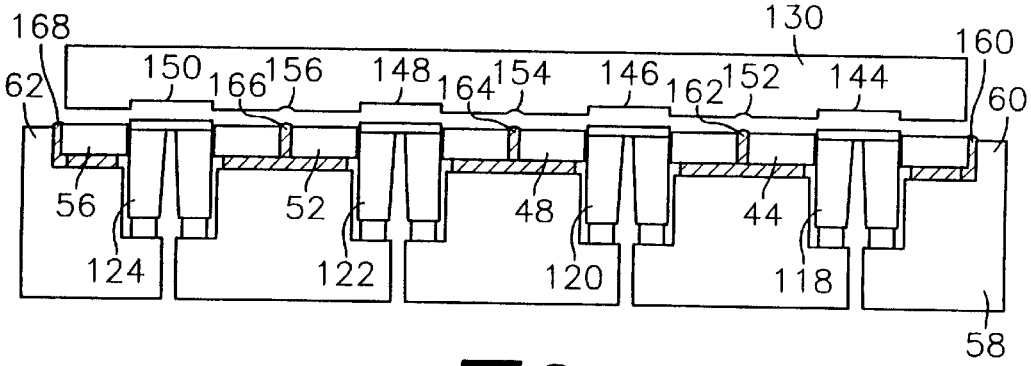

Reference is now made to FIGS. 7 and 8, which illustrate a sequence for attaching flexible circuits to an ink jet pen body. According to the method, an adhesive film 108 is placed in a recessed area 70 of the ink jet pen body 58 with apertures 110, 112, 114 and 116 (FIG. 6) aligned with chip pockets 64 in the body 58, and adhesive 66 is placed in chip pockets 64. Next the nozzle plate/chip assemblies 118, 120, 122 and 124 associated flexible circuits 44, 48, 52 and 56 are aligned so that ink feed ports of the pen body 58 such as feed port 126 are in flow communication with ink vias such as via 128 in the nozzle plate/chip assemblies 118, 120, 122 and 124. Once the nozzle plate/chip assemblies 118, 120, 122 and 124 are placed and aligned in the chip pockets 64, the adhesive 66 is cured to adhesively bond the nozzle plate/chip assemblies 118, 120, 122 and 124 to the chip pockets 64. After curing the nozzle plate/chip assemblies 118, 120, 122 and 124, a hot bar 130 is pressed in the direction of arrows 132 against the flexible circuits 44, 48, 52 and 56 to heat the flexible circuits and adhesive film 108 thereunder and cause the film to soften and flow to fill gaps 134, 136 and 138 between flexible circuits 44, 48, 52 and 56 and to fill gaps 140 and 142 between flexible circuits 44 and 56 and raised end walls 60 and 62 of the pen body 58. The temperature of the hot bar 130 preferably ranges from about 80° to about 150° C. Too high a temperature may cause damage to the delicate electronic parts and/or pen body 58 while too low a temperature may not be sufficient to cause the thermoplastic adhesive to soften and flow. The pressure applied by the hot bar 130 preferably ranges from about 5 to about 60 psig.

As shown in FIG. 7, it is preferred that the hot bar 130 contain recessed areas 144, 146, 148 and 150 corresponding to nozzle plate/chip assemblies 118, 120, 122 and 124 so that excessive heat and/or pressure are not applied to the assemblies during the heating and pressure steps. Additional indentations 152, 154 and 156 may be provided in the hot bar 130 to enable the adhesive material to encapsulate the entire edge of each of the flexible circuits 44, 48, 52 and 56 so that the adhesive material has a height which is on the same plane as the flexible circuits or slightly above the surface as shown by protrusions 160, 162, 164, 166 and 168. Because none of the edges of the flexible circuits 44, 48, 52 and 56 extend above the protrusions 160, 162, 164, 166 and 168 formed by the extruded film 130 or above raised end walls 60 and 62 (FIG. 8), the wiper 84 (FIG. 4) can easily glide over the printheads and nozzle plates without significantly wearing or damaging the flexible circuits or the wiper 84.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. An ink jet pen for an ink jet printer which comprises a pen body having raised end walls, a recessed substantially planar portion between the end walls containing two or more printheads and flexible circuits therefor, each of the flexible circuits having at least one exposed edge, the flexible circuits being attached to the pen body in the recessed portion between the raised end walls and a polymeric thermoplastic material disposed between adjacent flexible circuits in the recessed portion, the thermoplastic material having a height sufficient to protect a wiper from the exposed edges of the flexible circuits between adjacent printheads during a printhead cleaning operation.

2. The ink jet pen of claim 1 wherein each flexible circuit contains first and second edges and the polymeric material encapsulates the first and second edges of the flexible circuits.

3. The ink jet pen of claim 1 wherein the polymeric material comprises a polyolefin, non-curing thermoplastic bonding film or a polyurethane ether, non-curing thermoplastic bond film.

4. The ink jet pen of claim 1 wherein the polymeric material comprises a thermoplastic adhesive for attaching the flexible circuits to the pen body.

5. The ink jet pen of claim 4 wherein the adhesive comprises an ink resistant adhesive.

6. A method for protecting a wiper of a printhead cleaning station of an ink jet printer from damage from edges of a flexible circuit attached to an ink jet pen during a printhead cleaning operation which comprises, providing a pen body having raised end walls, a recessed substantially planar portion between the end walls, applying a thermoplastic adhesive film to the planar portion of the pen body, attaching one or more printheads and one or more flexible circuits therefor to the adhesive film in the recessed portion of the pen body, the one or more flexible circuits having first and second edges, heating the flexible circuits and film under pressure to a temperature sufficient to cause the adhesive film to flow and encapsulate at least one of the first or second edges of the flexible circuits and cooling the flowed adhesive film in the encapsulated state to harden the flowed film and provide the first and second edges in a protected state sufficient to protect the wiper from damage during a printhead cleaning operation.

7. The method of claim 6 wherein the adhesive film comprises a polyolefin, non-curing thermoplastic bonding film or a polyurethane ether, non-curing thermoplastic bond film.

8. The method of claim 6 wherein the adhesive film comprises a thermoplastic polymer for attaching the flexible circuits to the pen body.

9. The method of claim 8 wherein the thermoplastic polymer comprises an ink resistant adhesive.

10. The method of claim 6 wherein the flexible circuits and adhesive are heated to a temperature in the range of from about 80° to about 150° C.

11. The method of claim 6 wherein the pressure ranges from about 5 to about 60 psig.

12. An ink jet printer comprising a printer housing and a printhead cleaning station in the housing, the printer containing an ink jet pen and ink cartridge containing ink attached to the pen, the pen including a pen body having raised end walls, a recessed substantially planar portion between the end walls containing two or more printheads and flexible circuits therefor, each flexible circuit having at least one exposed edge, the flexible circuits being attached to the pen body in the recessed portion between the raised end walls, a thermoplastic polymeric material disposed between adjacent flexible circuits in the recessed portion and having a height sufficient to protect a wiper from damage caused by exposed edges of the flexible circuits between adjacent printheads during a printhead cleaning operation.

13. The ink jet printer of claim 12 wherein the printhead cleaning station contains the wiper.

14. The ink jet printer of claim 13 wherein the wiper comprises a flexible body, the flexible body having a mounting portion, a wiping portion and a beam portion connecting the wiping portion to the mounting portion, the wiping portion having an upper substantially planar surface having first and second opposing wiping edges and first and second opposing side surfaces opposite the upper surface which diverge at an acute angle from the first and second wiping edges respectively and intersect the beam portion on opposing sides thereof.

15. The ink jet printer of claim 12 wherein each flexible circuit contains first and second edges and the polymeric material encapsulates the first and second edges of the flexible circuits.

16. The ink jet printer of claim 12 wherein the polymeric material comprises a polyolefin, non-curing thermoplastic bonding film or a polyurethane ether, non-curing thermoplastic bond film.

17. The ink jet printer of claim 12 wherein the polymeric material comprises a thermoplastic adhesive for attaching the flexible circuits to the pen body.

18. The ink jet printer of claim 17 wherein the adhesive comprises an ink resistant adhesive.

* * * * *